US006068895A

United States Patent [19]

Kimura

[11] Patent Number: 6,068,895

[45] Date of Patent: May 30, 2000

[54] WOVEN SECURITY LABEL

[75] Inventor: Yoshihiro Kimura, Fukui, Japan

[73] Assignee: Nippon Dom Co., Ltd., Japan

[21] Appl. No.: 08/918,970

[22] Filed: Aug. 27, 1997

[51] Int. Cl.[7] ..... B44F 1/10

[52] U.S. Cl. ..... 428/29; 428/913; 428/916; 442/301

[58] Field of Search ..... 428/29, 913, 916; 442/301

[56] References Cited

U.S. PATENT DOCUMENTS

| | | | |
|---|---|---|---|
| 4,921,280 | 5/1990 | Jalon | 283/88 |
| 5,770,110 | 6/1998 | Schrell et al. | 252/301.36 |
| 5,824,393 | 10/1998 | Nakamura | 428/195 |

FOREIGN PATENT DOCUMENTS

| | | |
|---|---|---|
| 0 066 854 | 12/1982 | European Pat. Off. . |
| 0328320 | 8/1989 | European Pat. Off. . |
| 0 621 574 A1 | 10/1994 | European Pat. Off. . |
| 6-306727 | 11/1994 | Japan . |

OTHER PUBLICATIONS

English translation of abstract for EP 66 854 (West 1.0, Derwent database).

Printout of WPIDS database entry for JP 06–306727 (equivalent to EP 621574).

*Primary Examiner*—Blaine Copenheaver
*Assistant Examiner*—Cheryl Juska
*Attorney, Agent, or Firm*—Morrison Law Firm

[57] ABSTRACT

A woven security label is woven from threads of synthetic fiber, which interweaves a piece of check warp or weft yarn. The check warp or weft yarn comprises one or more pieces of detectable filament containing a small amount of inorganic fluorescent substance. The check warp or weft yarn is substantially colorless in ordinary sunlight, electric light or the like but reversibly changes color under influence of specific UV light.

5 Claims, 2 Drawing Sheets

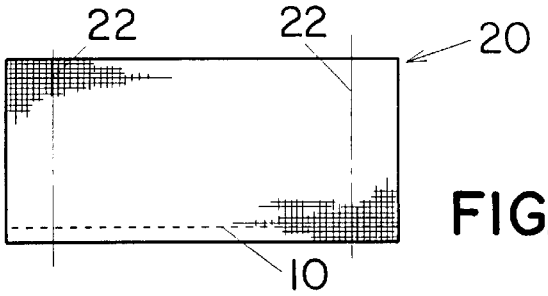
FIG. 3
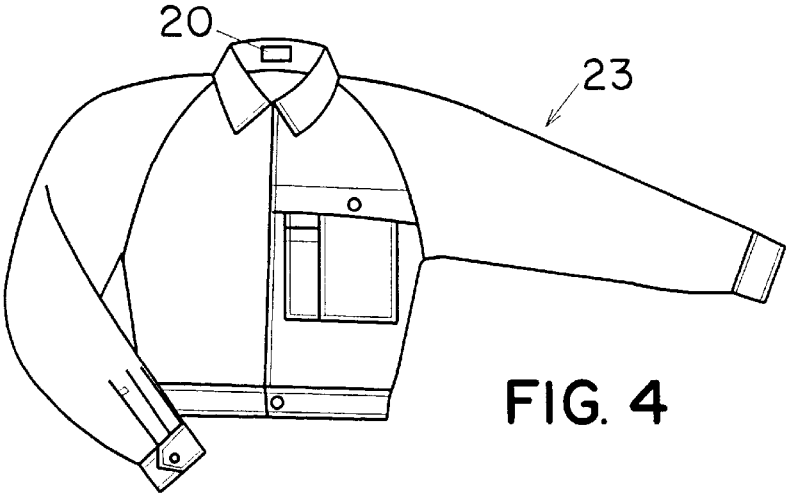
FIG. 4
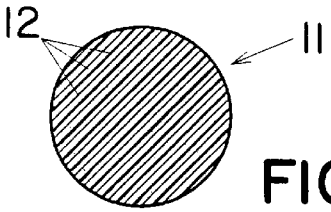
FIG. 5
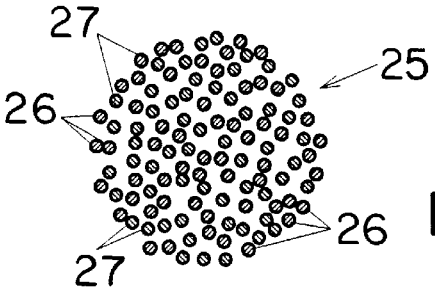
FIG. 6
FIG. 7
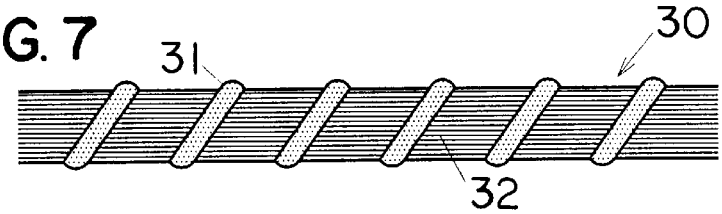

WOVEN SECURITY LABEL

BACKGROUND OF THE INVENTION

The present invention relates to a woven security label, and particularly to a woven security label that reversibly emits a straight color line when radiated with specific UV light. In the woven label, a warp or weft yarn consisting of one or more pieces of detectable filament is interwoven with ordinary warp and weft threads of synthetic fiber.

As quality or design for articles clothing become more diversified, it is harder for consumers to select and purchase desired articles. It becomes clear that famous trademarks and popular character brands goods are preferred for purchase and requested by a consumer, so the value of the famous trademarks or popular character brands has risen more and more. With rising value, the number of dealers who use and infringe famous trademarks and popular character brands on counterfeit goods is on the increase. Thus, manufacturers or distributors must attach security label to their marketing articles such as goods or packages in order to prove their authenticity.

In a conventional security device such as woven label, it is well known to interweave photochromic yarn into the label, as described in European Patent No. 328320. The photochromic yarn is substantially colorless when irradiated with visible light and reversibly converts to a colored state when irradiated with UV light. The photochromic yarn consists of fiber containing one or more photochromic compounds or mixture thereof. Two classes of suitable photochromic compounds are spiro-pyrans and spiro-oxazines. It is not possible to make them easily in large quantities, so it is very expensive to use them. Furthermore, there is the additional problem of indistinct color-change with UV light.

It has also been suggested weaving threads using inorganic fluorescent substances into security label with letters, symbols or pattern, in Japanese Patent Open Publication No. 6-306727. In this publication, however, it is not evident to describe a method for making the threads and using the inorganic fluorescent substance at all.

SUMMARY OF THE INVENTION

The present invention provides a woven security label interweaving a piece of check warp or weft yarn consisting of one or more pieces of detectable filament. The filament contains a small amount of inorganic fluorescent substance having a composition of $Sr_5(PO_4)_3Cl$:Eu, $Zn_2GeO_2$:Mn or $Y_2O_2S$:Eu. The fluorescent substance is preferable 1 to 3 $\mu$m in diameter. The fluorescent substance does not emit afterglow in sunlight and the light of an electric or fluorescent lamp, but it can emit afterglow for a very short period under influence of specific UV light having wavelength of 254 and/or 365 nm. Accordingly, the check warp or weft yarn is substantially colorless in ordinary sunlight, electric light or the like and reversibly changes color for a very short period under influence of specific UV light.

Preferably, the detectable filament contains a small amount of the inorganic fluorescent substance having a composition of $Y_2O_2S$:Eu, so that they change to red color for a short period of time when radiated with specific UV light having a wavelength of 254 and/or 365 nm. It is difficult to ascertain whether the security label is true or not, in the case of changing blue or green, because garments bleached with a fluorescent decolorant emit blue luminescence. The polymer material containing the inorganic fluorescent substance is preferably transparent or translucent synthetic fiber, for example, well-known polyester, nylon, polypropylene, cellulose diacetate or acrylic polymer and one or more pieces of the detectable filament are spun out of the polymer material. As a check yarn, there may be used one or more pieces of the detectable filament or a twisted thread thereof. Then, the check warp or weft yarn is interwoven into the wide figured cloth when weaving it on a loom with a jacquard. In the case of the check warp yarn, it may be slid through an eye of the heddle on each pattern unit of the wide figured cloth, respectively, and then it is longitudinally interwoven into the wide figured cloth. In the case of the check weft yarn, it may be inserted into a wide figured cloth on each width of the security label by means of the weft feeder, and then it is transversely interwoven into the wide figured cloth.

The loom used in the present invention is, for example, a shuttleless loom, gripper shuttle loom or water or air jet loom. On the breastbeam of the loom, the moving wide figured cloth may be cut on each pattern unit thereof with many heating knives attached in parallel. The wide figured cloth is finally cut into many strips of label element with heating. Subsequently, each strip of the label elements is cut into many pieces of label with heating.

The various aspects of the invention will be more fully understood when the following description is read in conjunction with accompanying drawings wherein:

It is accordingly the object of the invention to provide a woven security label used for ascertaining genuine articles such as garments, bags, towels, carpets, accessories or the like.

It is the another object of the invention to provide a woven security label for articles wherein their genuines is ascertained when the label is radiated with specific UV light.

It is the still another object of the invention to provide a woven security label which can be easily prepared at relatively low cost.

These and other objects, features and advantages of the invention will become more apparent to those skilled in the art from the following description.

BRIEF DESCRIPTION OF THE DRAWINGS

FIG. 3 is a plan view of a woven security label of the invention;

FIG. 4 is a front view showing an example of a garment on which the woven label of FIG. 3 is sewed;

FIG. 5 is an enlarged cross sectional view of first example of a detectable filament for a warp or weft yarn;

FIG. 6 is an enlarged cross sectional view of a complex thread for check yarn employed in the invention; and FIG. 7 is an enlarged view of second example of complex thread.

DETAILED DESCRIPTION OF THIS INVENTION

Figure 2:
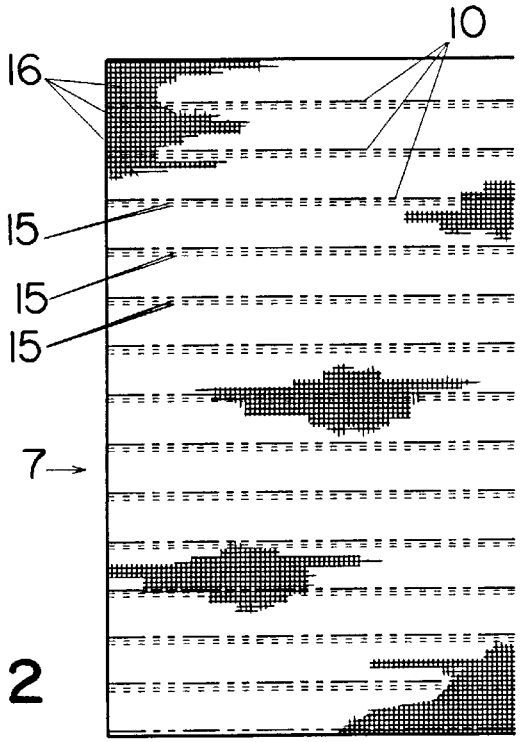
FIG. 2 is a partial plan view of the wide figured cloth prepared on the loom.

Referring to the drawings, FIG. 5 shows an example of a detectable filament 11 used for this invention. The detectable filament 11 was made by adding about 20 weight percentage of inorganic fluorescent substance 12 to polyester dope, and spinning filaments out of the polyester dope. Preferably, the fluorescent substance 12 has composition of $Y_2O_2S$:Eu and is 1 to 3 $\mu$m in diameter. The fluorescent substance 12 can emit red afterglow for a very short period of time in specific UV light having wavelength of 254 and/or 365 nm. At the next step, three pieces of the detectable filament 11 were generally twisted into a piece of check warp yarn 10 (FIG. 2). The check warp yarn 10 is substantially colorless in ordinary sunlight, electric light or the like and reversibly changes color for a very short period of time under influence of specific UV light.

Figure 1:
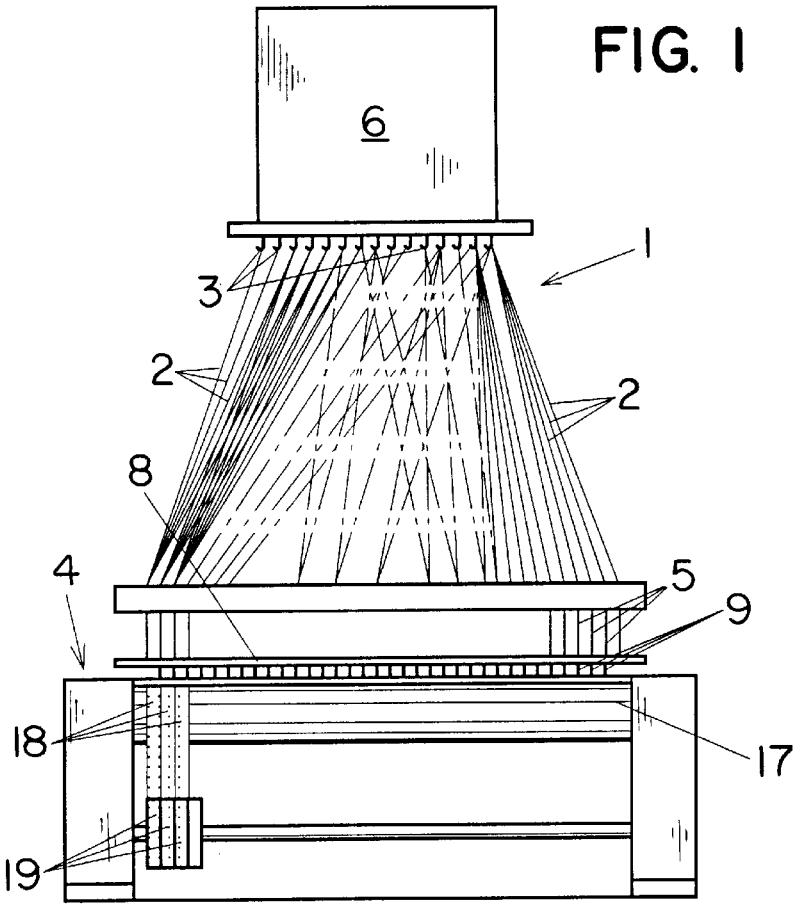
FIG. 1 is a schematic front view showing a loom with a jacquard used for weaving the wide figured cloth.

As shown in FIG. 1, in a known jacquard 1, the individual warp yarns are controlled each one of heddles 5 and the heddle harness 2 is replaced by a series of upright wires with hooks 3 at their upper ends. These hooks 3 were attached to the jacquard head 6 above a loom 4 and holes were punched in the pattern card (not shown) corresponding to the weave letters, symbols and/or pattern of a wide figured cloth 7, as seen in FIG. 2. The pattern card was fed through the jacquard head 6. The presence or absence of holes in the pattern card determines whether each warp yarn is raised or lowered. Heating knives 9 were attached downward to the horizontal frame 8 of the loom 4 and arranged in parallel to the moving cloth 7. The wide figured cloth 7 was 700 to 2600 mm in width. The distance of each two of the knives 9 is nearly equal to the width of the pattern unit 16 of the cloth 7.

When the wide figured cloth 7 was woven on the loom 4, a piece of the check warp yarn 10 and two pieces of guide yarn 15 were slid through an eye of the heddle 5 on each pattern unit 16 thereof, respectively. Then, the check yarn 10 and the guide yarn 15 were longitudinally interwoven into the wide figure cloth 7, as seen in FIG. 2.

Instead of said warp yarn, a piece of check weft yarn can be transversely interwoven into a wide figured cloth. In the case of the weft yarn, a piece thereof was inserted into the wide figured cloth on each width of the security label by means of the weft feeder of the loom, while two pieces of guide yarn 15 were slid through an eye of the heddle 5 on each pattern unit 16 of the cloth.

After weaving, the moving wide figured cloth 7 was immediately cut with heating on the breastbeam 17 of the loom 4. As the cloth 7 is forwarded, it moves so laterally that each one of the heating knives 9 may be located between the adjacent two of the woven guide yarns 15 and 15. The wide figured cloth 7 was cut into strips 18 of label element and reeled up on each one of winder 19. Subsequently, each strip 18 of the label element was cut into pieces of label 20 with another heating cutter (not shown).

As exemplified in FIG. 3, each side of the label element 20 was folded with a heating press (not shown) at the lines 22 and 22. In the case of the check warp yarn 10, it is located in the edge of the label 20, as seen in FIG. 3. The check warp 10 or weft yarn comes to the surface of the label 20 by choosing suitable weave pattern. For example, the label 20 may be sewed on the other side of the neck or the hidden side of a garment such as a windbreaker or jacket 23, as seen in FIG. 4. When the label 20 is radiated with UV light having a wavelength of 254 and/or 365 nm, a straight line of red luminescence appears on the surface thereof. However, there is no change in the surface of the label 20, even if it is radiated with sunlight or UV light having wavelength with the exception of 254 and/or 365 nm.

In the present invention, a piece of complex thread 25 or 30 as shown in the FIGS. 6 or 7 can be used as check yarn if the tensile strength of twisted pieces of detectable filament is too low or weak to be enough for check yarn. For example, the complex thread 25 was prepared by putting pieces of detectable filament 26 together with pieces of reinforcement yarn 27 by means of known multiple spooling machine, and then twisting them by means of known ringtwister or doubletwister. The complex thread 30 was prepared by distributing a sliver of fiber among a drafting zone, sending drafted sliver of fiber without twisting into hollow spindle and winding a piece of detectable filament 31 around the bundle of reinforcement fiber 32 at the this moment.

Ordinary dealers and consumers can confirm securely and easily whether articles are authentic or not, when they irradiate the label 20 sewed on the articles with specific UV light from a miniature lamp. According to the woven label 20, it is difficult to confirm existence of the check yarn 10 because the yarn 10 of the woven label 20 is usually in the same color state as the ordinary yarn thereof under influence to sunlight or normal fluorescent light. Consequently, it is almost impossible for corrupt traders to falsify the label of this invention.

It is possible to prepare easily the security label of this invention by interweaving only one piece of check warp or weft yarn into the cloth. This woven label can be manufactured at a low price with the same typical jacquard and loom as before.

Forgery articles can be detected early and securely by this woven label, even if the forgery resembles a genuine article. A manufacturer of authentic articles and the general consumer are protected from being fooled by the forgery goods promptly as a result of use of the label.

What is claimed is:

1. A security device attachable to an article for use in confirming article authenticity, said security device comprising a label of woven material, and one of a check warp and a check weft yarn made from synthetic filaments interwoven with the label, the said one of a check warp and a check weft yarn comprising a detectable filament containing an inorganic fluorescent substance selected from the group consisting of $Sr_5$ $(PO_4)_3$ Cl:Eu, $Zn_2GeO_2$:Mn and $Y_2O_2S$:Eu, the detectable filament being made by adding inorganic fluorescent substance 1 to 3 $\mu$m in diameter to a synthetic resin dope and spinning filament out of the resin material, the said one of a check warp and a check weft yarn being substantially colorless in a presence of sunlight and electric light but reversibly emitting a user discernible straight color line when irradiated with an UV light.

2. A security device in accordance with claim 1 in which the color which is emitted from the said one of a check warp yarn and check weft yarn is red appearing as a straight line of luminescence on a surface of the label when the label is radiated with UV light having a wavelength of 254 nm, 365 nm, or a combination thereof.

3. Method for making security labels which can be attached to articles for confirming article authenticity, said method comprising adding an inorganic substance which luminesces when radiated with UV light and selected from the group consisting $Sr_5$ $(PO_4)_3$ Cl:Eu, $Zn_2$ $GeO_2$:Mn and $Y_2O_2S$:Eu, having 1 to 3 $\mu$m in diameter, to a resin of one of polyester, nylon and polypropylene, spinning filaments out of the resin, providing one of a check warp and a check weft yarn from said filaments, weaving a wide figured cloth on a loom while interweaving the said one of a check warp and a check weft yarn into the wide figured cloth, cutting the wide figured cloth into label strips, and cutting individual widths of labels from each label strip.

4. Method for making a security label in accordance with claim 3 in which the said one of a check warp and a check weft yarn is a polyester check warp yarn and is slid through an eye of a heddle on each pattern unit of the wide figured cloth, and then the yarn is longitudinally interwoven into the wide figured cloth.

5. Method for making a security label in accordance with claim 3 in which the said one of a check warp and a check weft yarn is a polyester check weft yarn and is interwoven into the wide figured cloth each label width thereof, and is transversely interwoven into the wide figured cloth.

* * * * *